US009128409B2

(12) United States Patent
Hamaya

(10) Patent No.: US 9,128,409 B2
(45) **Date of Patent: *Sep. 8, 2015**

(54) CIRCUIT BOARD CONFIGURATION FOR IMAGE FORMING APPARATUS

(71) Applicant: Brother Kogyo Kabushiki Kaisha, Nagoya-shi, Aichi-ken (JP)

(72) Inventor: Masahito Hamaya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/268,520

(22) Filed: May 2, 2014

(65) Prior Publication Data

US 2014/0241743 A1 Aug. 28, 2014

Related U.S. Application Data

(63) Continuation of application No. 13/362,152, filed on Jan. 31, 2012, now Pat. No. 8,750,743.

(30) Foreign Application Priority Data

Feb. 14, 2011 (JP) ..... 2011-028441

(51) Int. Cl.
*G03G 15/00* (2006.01)
*G03G 21/18* (2006.01)
*G03G 15/043* (2006.01)

(52) U.S. Cl.
CPC ..... *G03G 15/043* (2013.01); *G03G 15/5004* (2013.01); *G03G 15/80* (2013.01); *G03G 21/1871* (2013.01); *G03G 2215/0141* (2013.01); *G03G 2221/169* (2013.01)

(58) Field of Classification Search
CPC ..... G03G 15/80; G03G 15/5004; G03G 21/1871; G03G 21/1867
USPC ..... 399/88, 90, 107, 110
See application file for complete search history.

(56) References Cited

U.S. PATENT DOCUMENTS 5,305,069 A 4/1994 Nakano
6,907,206 B2 6/2005 Hattori et al.

(Continued)

FOREIGN PATENT DOCUMENTS

CN 1499916 A 5/2004
CN 101154073 A 4/2008

(Continued)

OTHER PUBLICATIONS

The machine translation of reference Shimamura et al. (JP Pub No. 05-278,266 A) Pub Date Oct. 26, 1993.

(Continued)

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

An image forming apparatus is provided. The image forming apparatus includes a plurality of photosensitive members arranged to align in parallel with one another, an exposure device arranged in an upper position with respect to the plurality of photosensitive members and configured to expose the photosensitive members to light, an exposure controller arranged in an upper position with respect to the exposure device and configured to control the exposure device according to inputted image data, a power board, arranged in a lower position with respect to the plurality of photosensitive members and configured to convert alternate current power to direct current power, and a voltage converter arranged in an upper position with respect to the exposure device and configured to convert the direct current power supplied from the power board into an at least single-leveled first voltage and supply the first voltage to the exposure controller.

10 Claims, 3 Drawing Sheets

(56) References Cited

U.S. PATENT DOCUMENTS

| | | | |
|---|---|---|---|
| 7,843,483 | B2 | 11/2010 | Yokoi et al. |
| 7,954,917 | B2 | 6/2011 | Inoue |
| 7,979,003 | B2 | 7/2011 | Aoshima et al. |
| 2004/0131378 | A1 | 7/2004 | Hattori et al. |
| 2008/0079025 | A1 | 4/2008 | Inoue |
| 2009/0015062 | A1 | 1/2009 | Cho et al. |
| 2009/0034021 | A1 | 2/2009 | Taki et al. |
| 2009/0087219 | A1 | 4/2009 | Aoshima et al. |
| 2009/0169228 | A1 | 7/2009 | Yokoi et al. |
| 2010/0215393 | A1 | 8/2010 | Sasaki et al. |
| 2010/0239303 | A1 | 9/2010 | Matsumoto |
| 2011/0037823 | A1 | 2/2011 | Yokoi et al. |

FOREIGN PATENT DOCUMENTS

| | | | |
|---|---|---|---|
| CN | 101398652 | A | 4/2009 |
| CN | 101847930 | A | 9/2010 |
| JP | 01-314256 | A | 12/1989 |
| JP | H09-319174 | A | 12/1997 |
| JP | 2001-060024 | A | 3/2001 |
| JP | 2003-143343 | A | 5/2003 |
| JP | 2007-230150 | A | 9/2007 |
| JP | 2008-033051 | A | 2/2008 |
| JP | 2009-055588 | A | 3/2009 |
| JP | 2009157138 | A | 7/2009 |
| JP | 2010-272953 | A | 12/2010 |

OTHER PUBLICATIONS

The machine translation of the abstract of the reference Shimamura et al (JP Pub No. 05-278,266 A) Pub Date Oct. 26, 1993.

Notice of Allowance issued in U.S. Appl. No. 13/362,152 mailed Dec. 23, 2013.

Notification of Reasons for Rejection issued in corresponding Japanese Patent Application No. 2011-028441 mailed Jan. 28, 2014.

The First Office Action for Chinese Patent Application No. 201210022129.3 mailed Mar. 3, 2014.

Pending U.S. Appl. No. 13/313,332, filed Dec. 7, 2011.

Oct. 8, 2014—(CN) Second Office Action—App. 201210022129.3.

CIRCUIT BOARD CONFIGURATION FOR IMAGE FORMING APPARATUS

CROSS REFERENCE TO RELATED APPLICATION

This application is a continuation of U.S. patent application Ser. No. 13/362,152 filed Jan. 31, 2012, which claims priority from Japanese Patent Application No. 2011-028441, filed on Feb. 14, 2011. The entire contents of the above noted applications are hereby incorporated by reference.

BACKGROUND

1. Technical Field

An aspect of the present invention relates to an image forming apparatus having a plurality of photosensitive members aligned in parallel with one another and an exposure device arranged in an upper position with respect to the photosensitive members.

2. Related Art

An image forming apparatus (e.g., a printer) with a plurality of photosensitive drums and an exposure device (e.g., an LED unit) to emit light and expose the photosensitive drums to the light is known. The photosensitive drums may be aligned in line in parallel with one another, and the exposure device may be arranged in an upper position with respect to the plurality of photosensitive drums. The image forming apparatus may further have an exposure controller (e.g., an LED control board), which controls irradiation of the light from the exposure device, and the exposure controller may be arranged in an upper position with respect to the exposure device.

The image forming apparatus may further be equipped with a power board, which converts externally supplied alternating current power to direct current power. The power board may further convert the direct current power into different levels of voltages and supply the different-leveled voltages to each component deployed in the image forming apparatus.

SUMMARY

When the power board is arranged in a lower position with respect to the photosensitive drums (e.g., in a bottom section in the image forming apparatus), a longer cable to connect the power board in the lower section and the exposure controller in the upper section is required. When the cable connecting the power board and the exposure controller has a substantial length, voltage drop may occur in the long cable, and the exposure controller controlling the exposure device may be undesirably affected by the voltage drop. The undesirable influence of the voltage drop in the controlling behaviors may lower qualities of image to be formed in the image forming apparatus.

In order to reduce the undesirable influences of the voltage drop, for example, a quantity of cables connecting the power board and the exposure controller may be increased. For another example, thicker cables to connect the power board and the exposure controller may be arranged. With the increased number of cables or with the thicker cables, however, manufacturing cost for the image forming apparatus may be increased. Further, an increased quantity of connecting interfaces for the increased number of cables may be required. Furthermore, electrical noises may be increased, and the components in the image forming apparatus may be undesirably affected by increased electrical noises.

In view of the deficiencies, the present invention is advantageous in that an image forming apparatus, in which a cable to supply the power to the exposure controller is shortened, and in which the influence of voltage drop is lowered, is provided.

According to an aspect of the present invention, an image forming apparatus is provided. The image forming apparatus includes a plurality of photosensitive members, which are arranged to align in parallel with one another, an exposure device, which is arranged in an upper position with respect to the plurality of photosensitive members and is configured to expose the photosensitive members to light, an exposure controller, which is arranged in an upper position with respect to the exposure device and is configured to control the exposure device according to inputted image data, a power board, which is arranged in a lower position with respect to the plurality of photosensitive members and is configured to convert alternate current power to direct current power, and a voltage converter, which is arranged in an upper position with respect to the exposure device and is configured to convert the direct current power supplied from the power board into an at least single-leveled first voltage, of which absolute value is smaller than an absolute value of voltage of the direct current power supplied from the power board, and supply the first voltage to the exposure controller.

BRIEF DESCRIPTION OF THE ACCOMPANYING DRAWINGS

DETAILED DESCRIPTION

Figure 1:
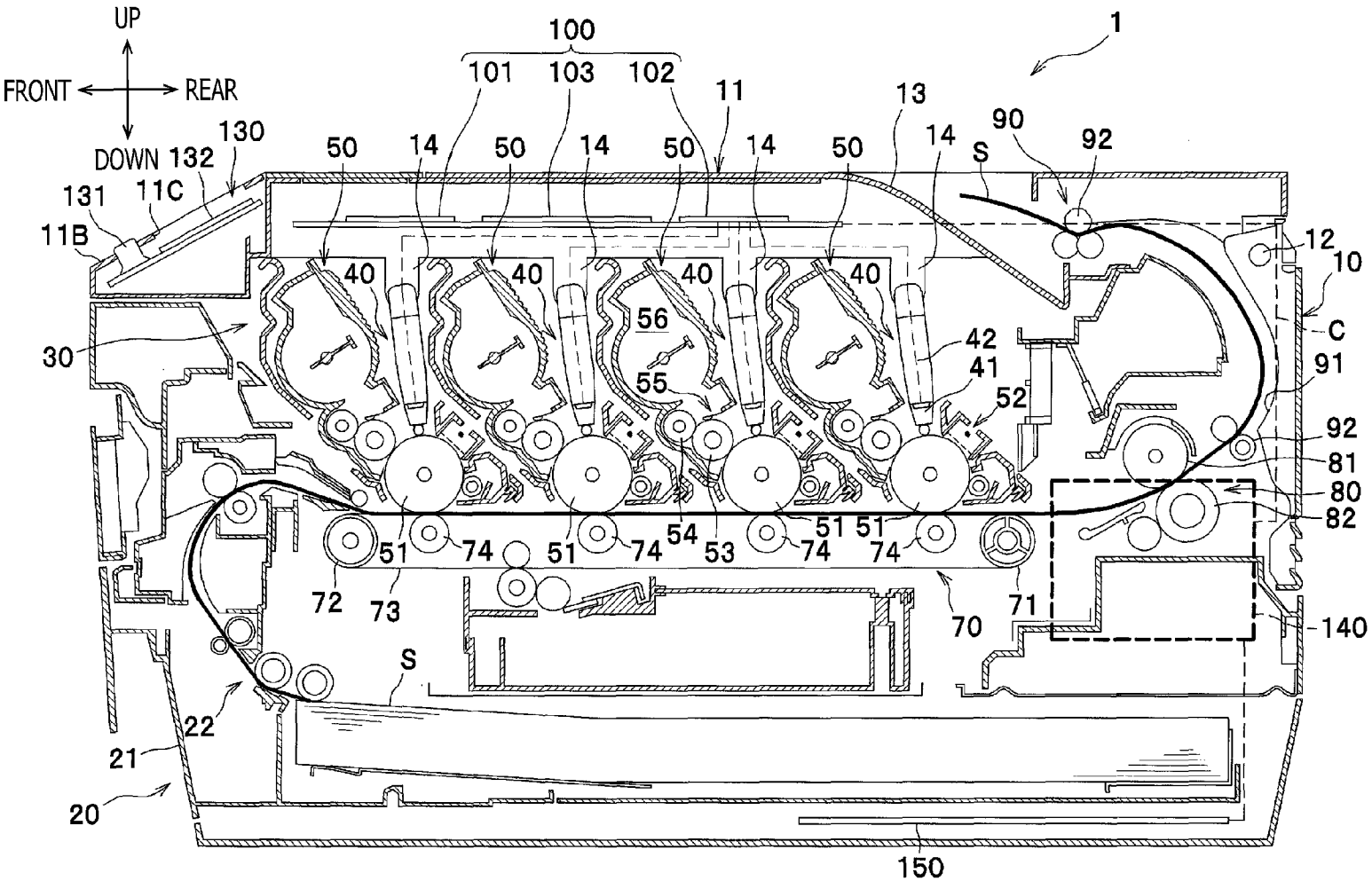
FIG. 1 is a cross-sectional side view of a color printer according to an embodiment of the present invention.

Hereinafter, an embodiment of the present invention will be described with reference to the accompanying drawings. In particular, overall and detailed configurations of a color printer 1 being an image forming apparatus will be described. In the present embodiment described below, directions concerning the color printer 1 will be referred to based on orientations indicated by arrows in each drawings. That is, for example, a viewer's left-hand side appearing in FIG. 1 is referred to as a front side of the color printer 1. A right-hand side in FIG. 1 opposite from the front is referred to as rear. The front-rear direction of the color printer 1 may also be referred to as a direction of depth. A side, which corresponds to the viewer's nearer side is referred to as a right-side face, and an opposite side from the right, which corresponds to the viewer's further side, is referred to as a left-side face. The right-left direction of the color printer 1 may also be referred to as a widthwise direction. The up-down direction in FIG. 1 corresponds to a vertical direction of the image forming apparatus.

Overall Configuration of the Printer

Figure 2:
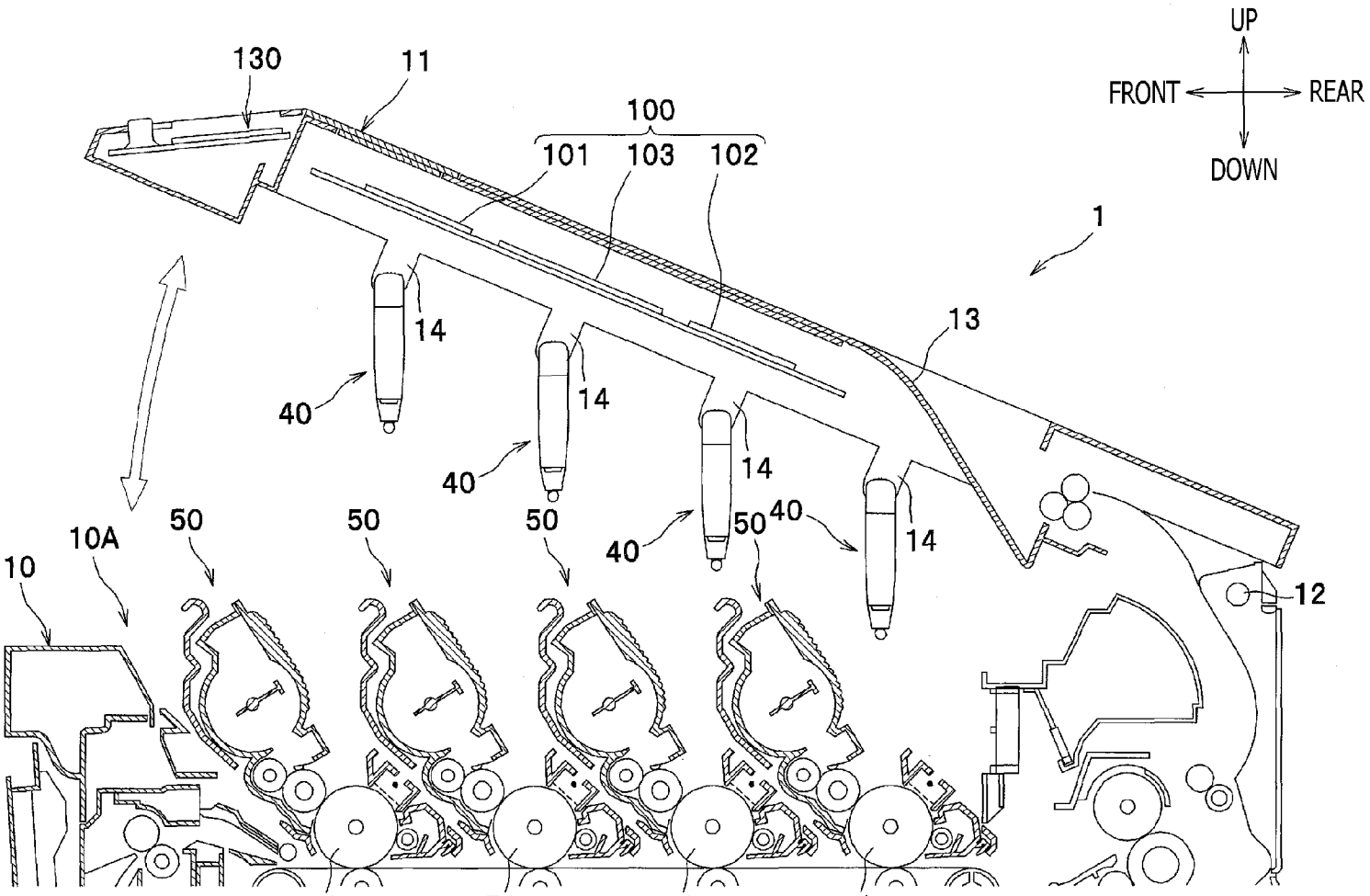
FIG. 2 is a cross-sectional partial view of the color printer according to the embodiment of the present invention with an upper cover being open.

An overall configuration of the color printer 1 according to the embodiment will be described with reference to FIGS. 1 and 2. The color printer 1 includes a main housing 10, an upper cover 11, a sheet feeding unit 20 to feed sheets S of recording paper, an image forming unit 30 to form images on the sheets S being fed, and a discharge unit 90 to eject the sheets S with the formed images out of the main housing 10.

The upper cover 11 is provided in an upper position in the main housing 10 and is movable between an open position (see FIG. 2) and a closed position (see FIG. 1) to uncover or cover an opening 10A, which is formed in a top plane of the main housing 10. More specifically, the upper cover 11 arranged on top of the top plane of the main housing 10 is pivotable about a pivot axis 12, which is provided on one end (e.g., rear end) of the main housing 10, to swing upwardly and downwardly. Thus, the upper cover 11 is openable and closable with respect to the opening 10A. The top plane of the upper cover 11 is formed to serve as a discharge tray 13, in which the sheets S ejected out of the main housing 10 are released. A lower plane of the upper cover 11 is formed to have a plurality of (e.g., four) attachment sections 14, to which LED units 40 being exposure devices are attached. The LED unit 40 will be described later in detail.

As shown in FIG. 1, the sheet feeding unit 20 is arranged in a lower section in the main housing 10 and includes a feeder tray 21, in which the sheets S are stored, and a sheet feeder 22, which separates the sheets S one-by-one and feeds to the image forming unit 30.

The image forming unit 30 includes a plurality of (e.g., four) LED units 40, a plurality of (e.g., four) processing units 50, a transfer unit 70, and a fixing unit 80.

The LED units 40 are attached to the lower plane of the upper cover 11 via the attachment sections 14 and arranged in upper positions with respect to photosensitive drums 51. Each of the LED units 40 includes an exposure head 41 and a support 42 which supports the exposure head 41.

The exposure head 41 extends in a direction parallel with an axial direction (i.e., widthwise direction) of the respective photosensitive drum 51 and is placed in a position to have a lower end thereof to vertically face the photosensitive drum 51 from above. The exposure head 41 includes a plurality of light-emitters (e.g., LEDs) (not shown), which align in line along the widthwise direction. The light-emitters emit beams according to signals transmitted from an LED controller 102, which will be described later in detail, to expose the photosensitive drum 51 having been charged by a charger 52 to the beams.

The support 42 serves to attach the exposure head 41 to the upper cover 11. The support 42 holds the exposure head 41 at a lower section thereof and is swingably attached to the upper cover 11 via the attachment section 14. Thus, the LED unit 40 is shifted apart from the photosensitive drum 51 when the upper cover 11 is open (see FIG. 2).

The processing units 50 are arranged along the direction of depth in a section between the upper cover and the feeder tray 21. The processing units 50 are removably installed in the in-between section via the opening 10A, which is exposed when the upper cover 11 is open, along the vertical direction with respect to the main housing 10. Each of the processing units 50 has the photosensitive drum 51, the charger 52, a developer roller 53, a supplier roller 54, a scraper blade 55, and a toner container 56. When the processing units 50 are installed in the main housing 10, the main housing 10 supports the photosensitive drums 51 to align along the direction of depth in parallel with one another.

The transfer unit 70 is arranged in a section between the feeder tray 21 and the processing units 50 and includes a driving roller 71, a driven roller 72, and an endless conveyer belt 73, which are extended to roll around the driving roller 71 and the driven roller 72, and a plurality of (e.g., four) transfer rollers 74. The conveyer belt 73 is in contact with the photosensitive drums 51 at an upper outer surface thereof when the processing units 50 are installed in the main housing 10. The transfer rollers 74 are arranged inside the conveyer belt 73 in opposite positions from the photosensitive drums 51 across the conveyer belt 73 and nip the conveyer belt 73 in cooperation with the photosensitive drums 51.

The fixing unit 80 is arranged in a rear position with respect to the processing units 50 and the transfer unit 70. The fixing unit 80 includes a heat roller 81 and a pressure roller 82. The pressure roller 82 is arranged in an opposite position from the heat roller 81 and is pressed against the heat roller 81.

In the image forming unit 30, as the photosensitive drums 51 rotate, circumferential surfaces of the photosensitive drums 51 are electrically charged evenly by the chargers 52 and are exposed to the LED units 40. In particular, the photosensitive drums 51 are exposed to the light emitted from the LED units 40 based on image data, which represents the image to be formed. Thus, latent images are formed in exposed regions on the circumferential surfaces of the photosensitive drums 51. Meanwhile, toners contained in the toner containers 56 are supplied to the developer rollers 53 via the supplier rollers 54 and carried in intervening sections between the developer rollers 53 and the scraper blades 55. Thus, the toners are provided in evenly-spread layers on the surfaces of the developer rollers 53.

The toners on the surfaces of the developer rollers 53 are supplied to the latent images formed on the circumferential surfaces of the photosensitive drums 51. Thus, the latent images are developed to form toner images on the surfaces of the photosensitive drums 51. As the sheet S is conveyed in positions between the photosensitive drums 51 and the conveyer belt 73 by the sheet feeding unit 20, the toner images formed on the surfaces of the photosensitive drums 51 are transferred to be laid over one another on the sheet S. The sheet S with the overlaid toner images is forwarded to the fixing unit 80 and conveyed in a section between the heat roller 81 and the pressure roller 82. Thus, the toner images are thermally fixed on the sheet S by the heat and the pressure.

The discharge unit 90 includes a discharge path 91, which guides the sheet S exited from the fixing unit 80 to discharge out of the main housing 3, and a plurality of conveyer rollers 92, which convey the sheet S. The sheet S with the thermally-fixed images is conveyed along the discharge path 91 by the conveyer rollers 92 to be ejected out of the main housing 10 and settled in the discharge tray 13.

Detailed Configuration of the Color Printer

Detailed configuration of the color printer 1 according to the embodiment of the present invention will be described with reference to FIG. 3. The color printer 1 includes a main board 100, an operation panel control board 130, a motor control board 140, a power board 150, and a motor M.

In the description below, a power-conductive wire to supply power will be referred to as a power line and indicated in a solid line in FIG. 3. Meanwhile, a signal transmitting wire to transmit electrical signals will be referred to as a signal line and indicated in a broken line. The power lines and the signal lines may be solid single wires or may be twisted wires. It is to be noted that FIG. 3 merely illustrates the power lines and the signal lines related to the present invention but may not necessarily represent all the power lines and signal lines to be used in the color printer 1.

The main board 100 is a printed circuit board, on which an image data processor 101, the LED controller 102, and a voltage converter 103 are provided. In other words, the image data processor 101, the LED controller 102, and the voltage converter 103 are provided on the same main board 100.

The main board 100 is arranged in an inner space in the upper cover 11 between the discharge tray 131 and the attachment sections 14 and is fixed to the upper cover 11. Thus, the image data processor 101, the LED controller 102, and the voltage converter 103 are arranged in the upper positions with respect to the LED units 40.

The image data processor 101 stores and processes image data inputted externally from external devices such as a personal computer. More specifically, when compressed image data is inputted from the external device, the image data processor 101 stores the image data in a RAM (not shown) and decompresses the image data. Further, the image data processor 101 converts a format of the decompressed image data into a format, which is usable in the color printer 1 (e.g., bitmap format). Thereafter, the image data processor 101 outputs the converted image data to the LED controller 102 via a signal line SL1.

Furthermore, the image data processor 101 transmits signals indicating activation timings to activate the motor M to a motor controller 141 via a signal line SL2. The signals indicating the activation timings may be inputted in the image data processor 101 along with the image data. Thus, the image data processor 101 controls the sheet feeding system, which includes the sheet feeder 22 and the conveyer rollers 91, and the image forming unit 30 via the motor controller 141. The motor controller 141 will be described later in detail.

According to the present embodiment, in order to conduct the above-described image-forming processes, the image data processor 101 includes a CPU (not shown) to compute arithmetic operations, a ROM (not shown) to store programs and parameters, a RAM (not shown) to store data such as the image data, and an I/O (input/output) interface (not shown), through which the image data is inputted and outputted.

The LED controller 102 receiving the image data from the image data processor 101 outputs signals reflecting the image data to the LED units 40 (more specifically, to the exposure heads 41) via signal lines SL3. Thus, the LED controller 102 manipulates the LEDs to turn on and off. The LED controller 102 and the image data processor 101 are mutually connected by the signal line SL1 within the main board 100.

The voltage converter 103 converts a direct current power V0 (e.g., 24V) supplied from the power board 150 into predetermined different-leveled voltages V1, V21, V22, V31, V32 and supplies the converted voltages to each component (e.g., the LED controller 102) in the color printer 1.

More specifically, in the present embodiment, the voltage converter 103 is connected with the LED controller 102 by a power line EL1 within the main board 100. The voltage converter 103 converts the direct current power supplied from the power board 150 into a first voltage V1 (e.g., 3.3V), of which absolute value is smaller than the voltage V0 of the direct current power, and supplies the power in the first voltage V1 to the LED controller 102 via the power line EL1.

Further, the voltage converter 103 is connected with the image data processor 101 by power lines EL2 and EL 3 within the main board 100. The voltage converter 103 converts the direct current power V0 supplied from the power board 150 into a second voltage including different-leveled voltages V21, V22 (e.g., 3.3V and 5.0V) and supplies the power in the two-leveled second voltages V21, V22 to the image data processor 101 via the power lines EL2, EL3.

Furthermore, the voltage converter 103 is connected with the motor control board 140 by power lines EL4 and EL 5. The voltage converter 103 converts the direct current power V0 supplied from the power board 150 into a third voltage including different-leveled voltages V31, V32 (e.g., 3.3V and 5.0V) and supplies the power in the two-leveled third voltages V31, V32 to the motor control board 140 via the power lines EL4, EL3.

The operation panel control board 130 is a circuit board, on which an operation panel controller (not shown) to receive a user's instruction is provided. The operation panel control board 130 is fixed to a front section inside the upper cover 11. As shown in FIG. 1, the operation panel control board 130 includes operation buttons 131 (solely one is shown in FIG. 1) and an LCD (liquid crystal display) panel 132. The operation buttons 131 are formed to protrude upwardly out of a front panel 11B of the upper cover 11 in order to allow the user to touch the buttons 131 and enter the instruction. The LCD panel 132 is visible to the user through a window 11C, which is formed in the front panel 11B of the upper cover 11.

Figure 3:
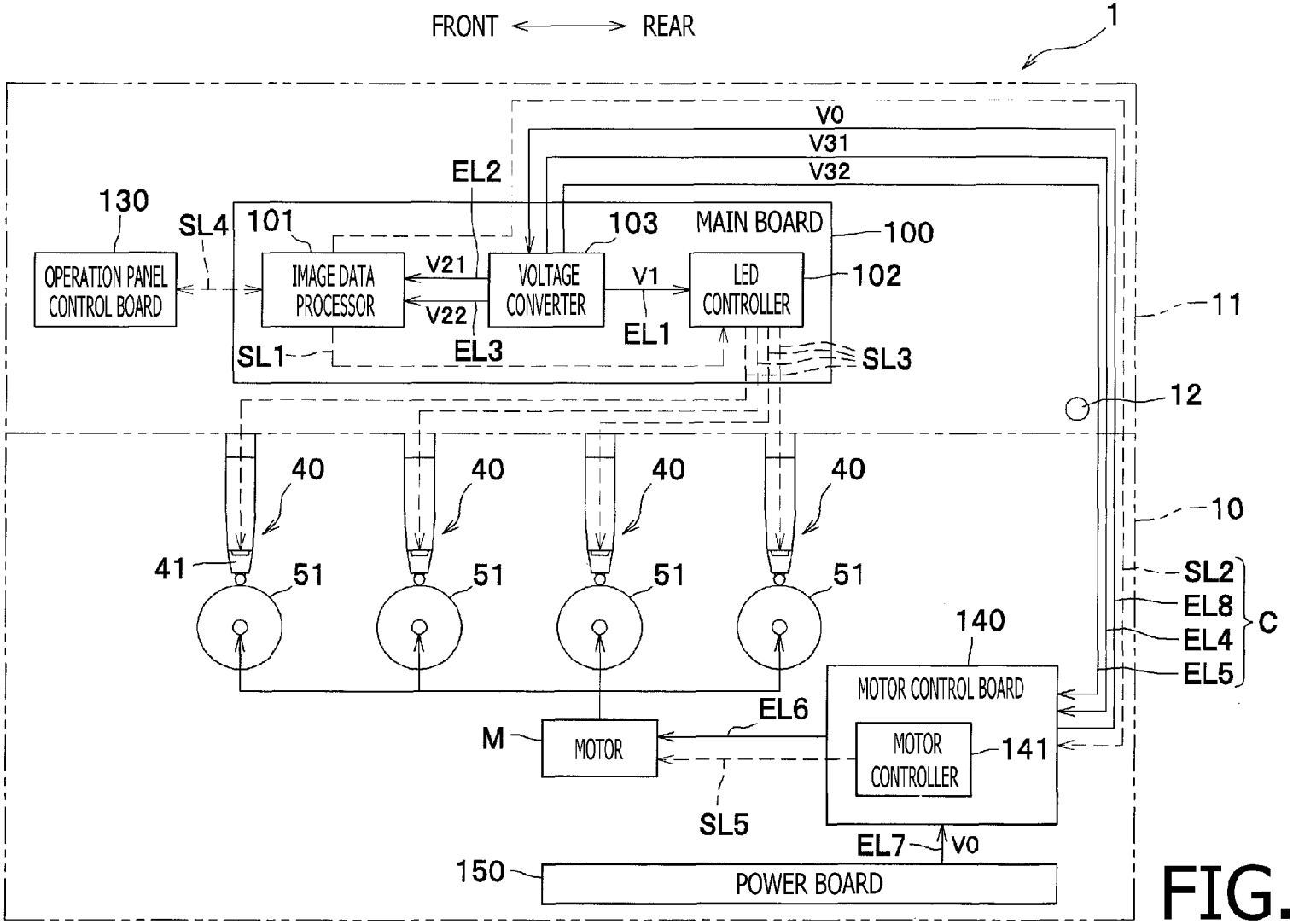
FIG. 3 is a diagram to illustrate arrangement of circuit boards and wires in the color printer according to the embodiment of the present invention.

As shown in FIG. 3, the operation panel control board 130 is connected with the image data processor 101 by a signal line SL4 and outputs the user's instruction entered through the operation buttons 131 to the image data processor 101 via the signal line SL4. Further, the operation panel control board 130 displays information concerning operations and behaviors of the color printer 1 through the LCD panel 132.

According to the present embodiment, the operation panel control board 130 and the main board 100 are fixed to the upper cover 11. In other words, a distance between the operation panel control board 130 and the main board 100 is constant. Therefore, it is not necessary that the signal line SL4 connecting the image data processor 101 and the operation panel control board 130 includes an absorbable length, which may allow at least one of the image data processor 101 and the operation panel control board 130 to move in a specific range. In other words, the signal line SL 4 connecting the image data processor 101 and the operation panel control board 130 may be shortened compared to a signal line connecting the image data processor and the operation panel control board, which are movable with respect to each other.

The motor M is fixed in an arbitrary position inside the main housing 10 and drives the sheet feeding system, which includes the sheet feeder 22 and the conveyer rollers 92, and the image forming unit 30, which includes the photosensitive drums 51, the developer rollers 53, the supplier rollers 54, the transfer rollers 74, and the pressure roller 82.

The motor control board 140 is a circuit board, on which the motor controller 141 is provided. According to the present embodiment, the motor control board 140 is fixed to a left-side rear section in the main housing 10 in an upright position (see FIG. 1). The motor controller 141 is connected with the image data processor 101 by the signal line SL 2 and controls behaviors of the motor M (e.g., activation/inactivation, rotation speeds, and rotating directions) in order to manipulate the sheet feeder system and the image forming unit 30.

According to the present embodiment, the motor control board 140 is fixed to the main housing 10, in which the motor M is stored. In other words, a distance between the motor control board 140 and the motor M is constant. Therefore, it is not necessary that the wires connecting the motor M with the motor control board 140 (e.g., the power line EL6 and the signal line SL5) includes an absorber length, which may allow at least one of the motor M and the motor control board 140 to move in a specific range. In other words, the wires connecting the motor M and the motor control board 140 may be shortened compared to wires connecting the motor and the motor control board, which are movable with respect to each other. Further, due to the arrangement of the motor M and the motor control board 140 described above, the wire routing and arrangement in the main housing 10 can be less complicated.

The power board 150 is a circuit board to convert alternate current power supplied from an external source, such as a commercial power source, in-house power generator, an uninterruptible power supply system, into direct current power in the voltage V0 and supplies the converted direct current voltage to the voltage converter 103 in the main board 100 via power lines including power lines EL7, EL8 and the motor control board 140. The power board 150 is arranged in a lower position with respect to the photosensitive drums 51. More specifically, the power board 150 is fixed in a lower position with respect to the feeder tray 21 and in vicinity to a rear end of the main housing 10 in a horizontally laid-flat orientation (see FIG. 3).

According to the present embodiment, the voltage V0 of the direct current power to be supplied from the power board 150 to the voltage converter 103 in the main board 100 is a single-leveled voltage (e.g., 24V) alone. In other words, the direct current power from the power board 150 to the voltage converter 103 is transmitted via a line including the power lines EL7, EL8 for the single-leveled voltage. Therefore, it is not necessary to provide wires for a plurality of voltage levels. Rather, a quantity of wires drawn from the power board 150 and a quantity of connectors (connecting interfaces) to be provided in the power board 150 for the wires, can be smaller compared to a quantity of wires and connectors for a power board, from which different-leveled voltages are supplied to the main board 100.

The direct current power from the power board 150 is initially supplied to the motor control board 140 via the power line EL 7. From the motor board 140, a part of the power is branched to be supplied to the motor M, and the other part of the power source is supplied to the voltage converter 103 via the power line EL8. Thus, as has been mentioned above, the direct current power from the power board 150 is supplied to the voltage converter 103 via the motor control board 140.

The motor control board 140 and the voltage converter 103 are connected with each other by wires including the power lines EL4, EL5, EL8, and the signal line SL2. In the present embodiment, wires to connect the motor control board 140 and the voltage converter 103 including the power lines EL4, EL5, EL8, and the signal lines SL2 are bundled into a flat cable C (see also FIG. 1). Therefore, the wire routing and arrangement may be less complicated than arranging a plurality of wires separately in the main housing 10.

The flat cable C drawn from the voltage converter 103 is routed along the rear side of the main housing 10, turned around at outer side of the pivot 12 of the upper cover 11, and directed inward to be connected to the motor control board 140. By this routing, it is prevented that the flat cable C connecting the motor control board 140 with the voltage converter 103 disturbs or suspends the opening and closing movement of the upper cover 11 (see also FIG. 2).

According to the color printer 1 described above, the LED controller 102 and the voltage converter 103 to supply the power to the LED controller 102 are fixedly arranged in the upper positions with respect to the LED units 40 and in vicinity to each other within the upper cover 11. Therefore, the power line EL1 connecting the LED controller 102 and the voltage converter 103 may be shortened than a length, which may be required for a power line to connect the LED controller and the voltage converter being in distant positions from each other. Accordingly, even when voltage drop occurs in the power line EL 1, which supplies the converted first voltage V1 to the LED controller 102, whilst the absolute value of the first voltage V1 is smaller than the voltage V0 of the direct current power supplied from the power board 150, influence which may be derived from the voltage drop can be lessened. Therefore, debasement of the image forming quality of the color printer 1 may be prevented.

According to the color printer 1 described above, further, the image data processor 101 and the LED controller 102 are fixedly arranged in the upper positions with respect to the LED units 40 and in vicinity to each other. Therefore, the signal line SL1 to electrically connect the image data processor 101 with the LED controller 102 may be shortened than a length, which may be required for a signal line to connect the image data processor 101 with the LED controller 102 being in distant positions from each other. Accordingly, debasement of the image forming quality of the color printer 1, which may be caused by the electrical noises affecting the signal line SL1, may be lessened.

In particular, the color printer 1 according to the present embodiment has the single circuit board (i.e., the main board 100) which includes the image data processor 101, the LED controller 102, and the voltage converter 103. Therefore, compared to a color printer having separate circuit boards for the image data processor, the LED controller, and the voltage converter respectively, the color printer 1 according to the present embodiment may have the voltage converter 103 and the LED controller 102 in closer positions with each other, and the image data controller 101 and the LED controller 102 in closer positions with each other. In other words, the lengths of the power line EL1 and the signal line SL1 may be shortened. Accordingly, debasement of the image forming quality of the color printer 1, which may be caused by the voltage drop in the power line EL1 and by the electrical noises affecting the signal line SL1, may be lessened.

In the color printer 1 described above, the power line L8 to supply the direct current power in the voltage V0 to the voltage converter 103 may have a substantial length. However, whilst the voltage V0 is a higher-leveled voltage (e.g., 24V) than the voltages V1 (e.g., 3.3V), V21 (e.g., 3.3V), V22 (e.g., 5.0V), V31 (e.g., 3.3V), and V32 (e.g., 5.0V), a degree of power decay in the power line EL8 may be limited to be small.

In the color printer 1 described above, the voltage V0 of the direct current power to be supplied from the power board 150 to the voltage converter 103 is the single-leveled voltage (e.g., 24V) alone. Therefore, it is not necessary to provide wires for a plurality of different voltage levels. Rather, a quantity of wires drawn from the power board 150 and a quantity of connectors (connecting interfaces) to be provided in the power board 150 for the plurality of wires, can be reduced.

Further, the voltage converter 103 is provided in the main board 100, which includes the image data processor 101, and supplies power being the direct current power converted into the second voltage (i.e., V21, V22) to the image data processor 101. In other words, the power supplied from the power board 150 is transmitted to the voltage converter 103 in the main board 100 and forwarded to the image data processor 101 within the main board 100. Therefore, a quantity of power lines drawn from the power board 150 and a quantity of connectors to be provided in the power board 150 for the power lines can be smaller compared to a color printer, in which the image data processor and the voltage converter are respectively provided in separate circuit boards, and the direct current power is separately and directly supplied to the image data processor and to the voltage converter from the power board 150.

Furthermore, the voltage converter 103 supplies the power being the direct current power supplied from the power board 150 and converted into the third voltage (i.e., V31, V32) to the motor controller 141. Therefore, a quantity of power lines drawn from the power board 150 and a quantity of connectors to be provided in the power board 150 for the power lines can be smaller compared to a color printer, in which the direct current power is separately and directly supplied to the motor controller 141 and to the voltage converter 103.

As has been described above, according to the present invention, the quantity of the wires to be drawn from the power board 150 and the quantity of connectors to be provided in the power board 150 for the wires can be reduced. Therefore, wire arrangement and routing in the color printer 1 can be simplified. Further, with the simplified wire routing, arrangement of the power board 150 may be more flexibly designed. Furthermore, with the reduced quantity of the connectors, the power board 150 may be downsized, and with the reduced quantity of the wires, internal space to be occupied by the wires may be smaller. Thus, a volume of the color printer 1 may be effectively downsized.

According to the embodiment described above, the voltage converter 103 and the motor control board 140 are connected with each other by the single flat cable C, which bundles a plurality of wires including the power lines EL4, EL5, and EL8. Therefore, the wire routing and arrangement may be less complicated than arranging a plurality of wires separately, and the volume of the color printer 1 may be effectively downsized.

According to the embodiment described above, the color printer 1 has the exposure device (e.g., the LED units 40) having a plurality of exposure heads 41, and each of the exposure heads 41 has a plurality of light-emitters (e.g., LEDs). In this regard, the power to drive the exposure device with the numbers of light-emitters is greater than power to drive an exposure device, which scans the surfaces of the photosensitive drums by laser beams. In other words, the LED units 40 in the color printer 1 of the present embodiment may be more sensitive to the voltage drop. Therefore, in the color printer 1 according to the present embodiment, in which the LED units 40 are arranged to respectively face the photosensitive drums 51, the configuration to reduce the influence of the voltage drop is particularly effective.

According to the embodiment described above, the LED units 40 and the main board 100 with the LED controller 102 are attached to the same upper cover 11; therefore, the LED units 40 and the LED controller 102 may be arranged in vicinity to each other. Thus, the signal lines SL3 connecting the LED controller 102 and the exposure heads 41 may be shortened than a length, which may be required for a signal line to connect the LED controller and the exposure heads of the LED units being in distant positions from each other. Accordingly, debasement of the image forming quality of the color printer 1, which may be caused by the electrical noises affecting the signal lines SL3, may be lessened.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the image data processor 101, the LED controller 102, and the voltage converter 103 may not necessarily be embedded in the single circuit board. For example, the image data processor 101 and the voltage converter 103 may be provided in a single circuit board whilst the LED controller 102 is provided in a different circuit board. Alternatively, the image data processor 101, the LED controller 102, and the voltage converter 103 may be provided in different circuit boards respectively.

For another example, the voltage converter 103 and the motor control board 104 may not necessarily be connected with each other by the single flat cable C but may be connected by a plurality of cables. For example, the voltage converter 103 and the motor control board 104 may be connected with each other by a cable including the power lines EL4, EL5, and EL8 and by a cable including a signal line SL2.

For another example, the voltage converter 103 may not necessarily convert the direct current power supplied from the power board 150 into the single-leveled first voltage V1. The first voltage may include two or more levels of voltages (e.g., 3.3V, 1.8V, etc.).

Further, the voltage converter 103 may not necessarily convert the direct current power supplied from the power board 150 into the two-leveled second voltages V21, V22 and into the two-leveled third voltages V21, V32 to supply to the image data processor 101 and the motor controller 141. The second voltage and/or the third voltage may include solely a single level or multiple levels of three or more.

For another example, the voltage V0 of the direct current power to be supplied from the power board 150 to the voltage converter 103 may not necessarily be the single-leveled voltage but may be voltages in multiple levels. That is, the direct current power converted from the alternate current power may be converted into a plurality of different-leveled voltages in the power board 150 and supplied to the voltage converter 103. In this regard, still the first voltage V1 being the direct current power to be supplied to the LED controller 102 is converted within the voltage converter 103.

For another example, the voltage converter 103 may not necessarily supply the converted direct current power to the image data processor 101 or to the motor controller 141. The voltage converter 103 may convert the direct current power initially supplied from the power board 150 into the first voltage, of which absolute value is smaller than the voltage of the initial direct current, and supply the converted first voltage solely to the LED controller 102. In this regard, the power to be supplied to the image data processor 101 and the motor controller 141 may be supplied from the power board 150, which may convert the direct current power having been converted from the alternate current power into the predetermined levels of voltages for the image data processor 101 and the motor controller 141.

For another example, the voltage converter 103 may convert the direct current power supplied from the power board 150 into all the necessary voltages, which are required in each component in the color printer 1, and distribute the converted voltages to the components. In this regard, a quantity of the wires to be drawn from the voltage converter 103 may increase. Further, a quantity of the connectors, through which the increased number of wires are connected to the voltage converter 13, may increase. In other words, a volume of the circuit board to have the voltage converter 103 may increase. However, the upper section inside the upper cover 11 above the LED units 40 is relatively spacious with a smaller quantity of components compared to the space in the main housing 10 below the photosensitive drums 51. Therefore, the increased volume of the circuit board to have the voltage converter 103 may be absorbable in the upper section inside the upper cover 11.

For another example, the motor control board 140 may not necessarily be fixed to the main housing 10 but may be fixed to, for example, the upper cover 11.

For another example, the LED units 40 may be replaced with other exposure devices. For example, the LED in the exposure head 41 being an exposure head may be replaced with an EL (electroluminescence) elements or a fluorescence substance. Further, the exposure head may have an optical shutter such as a liquid crystal element and a PLZT element on a light-emitting side, on which the light-emitter is provided. Furthermore, the exposure device may not necessarily have the exposure heads but may have, for example, one or more laser scanners.

For another example, the upper cover 11 may not necessarily be pivotable with respect to the main housing 10 about the pivot axis 12 in order to cover or uncover the opening 10A but may be, for example, shifted vertically in parallel with the main housing 10 to cover or uncover the opening 10A.

For another example, the image forming apparatus may not necessarily be the color printer 1 but may be other image processing apparatus such as a copier or a multifunction peripheral device having an image reading unit (e.g., a flatbed scanner).

What is claimed is:

1. An image forming apparatus, comprising:

an exposure device configured to expose a plurality of photosensitive members to light;

a conveyer belt arranged on an opposite side of the exposure device across the plurality of photosensitive members;

an exposure controller board configured to control the exposure device according to image data;

a power board arranged on an opposite side of the exposure device across the conveyer belt and configured to convert alternate current power to direct current power; and a voltage converter configured to convert the direct current power supplied from the power board into an exposure-usable voltage, which is a voltage to be used in the exposure device, and supply the converted exposure-usable voltage to the exposure controller board, wherein the voltage converter and the exposure controller board are arranged on one side of the plurality of photosensitive members, the one side being opposite to the conveyer belt across the plurality of photosensitive members.

2. The image forming apparatus according to claim 1, wherein the voltage of the direct current power supplied from the power board to the voltage converter is of a single-leveled value.

3. The image forming apparatus according to claim 1, wherein the exposure device comprises a plurality of exposure heads, each of which is arranged to face a respective one of the plurality of photosensitive members.

4. The image forming apparatus according to claim 1, further comprising:

an image data processor configured to store and process inputted image data and configured to output the processed image data to the exposure controller board, wherein the voltage converter is arranged on a circuit board, on which the image data processor is arranged, and is configured to convert the direct current power supplied from the power board into a processor-usable voltage, which is a voltage to be used in the image data processor, and supply the converted processor-usable voltage to the image data processor.

5. The image forming apparatus according to claim 4, wherein the voltage converter, the exposure controller, and the image data processor are arranged on a same circuit board.

6. The image forming apparatus according to claim 1, further comprising:

a motor arranged in a main housing of the image forming apparatus and configured to drive the plurality of photosensitive members; and a motor controller configured to control the motor, wherein a circuit board, on which the motor controller is arranged, is fixed to the main housing; and wherein the voltage converter is configured to convert the direct current power supplied from the power board into a motor-usable voltage, which is a voltage to be used in the motor, and supply the converted motor-usable voltage to the motor controller.

7. The image forming apparatus according to claim 6, wherein the direct current power from the power board is supplied to the voltage converter via the circuit board, on which the motor controller is arranged; and wherein a circuit board, on which the voltage converter is arranged, and the circuit board, on which the motor controller is arranged, are connected with each other by a single cable, which includes a plurality of conductive wires including a wire to supply the direct current power from the circuit board, on which the motor controller is arranged, to the voltage converter and a wire to supply the motor-usable voltage from the voltage converter to the motor controller.

8. The image forming apparatus according to claim 1, further comprising:

a main body configured to accommodate the conveyer belt and the plurality of photosensitive members; and a cover attached to the main body and configured to be openable and closable with respect to the main body, wherein the exposure device is attached to the cover, and wherein the voltage converter and the exposure controller board are arranged in the cover.

9. The image forming apparatus according to claim 1, wherein the voltage converter and the exposure controller board do not contact the conveyer belt.

10. The image forming apparatus according to claim 1, wherein the conveyer belt does not contact the exposure device.

* * * * *